US009540164B1

(12) United States Patent
Schumacher

(10) Patent No.: US 9,540,164 B1
(45) Date of Patent: Jan. 10, 2017

(54) TIME-DELAY ACTUATOR ASSEMBLY FOR AN AEROSOL CONTAINER

(71) Applicant: S.C. Johnson & Son, Inc., Racine, WI (US)

(72) Inventor: Donald J. Schumacher, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 22 days.

(21) Appl. No.: 14/739,471

(22) Filed: Jun. 15, 2015

Related U.S. Application Data

(60) Provisional application No. 62/013,012, filed on Jun. 17, 2014.

(51) Int. Cl.
*B65D 83/26* (2006.01)

(52) U.S. Cl.
CPC ..... *B65D 83/262* (2013.01)

(58) Field of Classification Search
CPC ..... B65D 83/262
USPC ..... 222/1, 649, 402.1, 402.14, 518
See application file for complete search history.

(56) References Cited

U.S. PATENT DOCUMENTS

| | | | | |
|---|---|---|---|---|
| 3,804,302 | A | 4/1974 | Yamada et al. | |
| 4,186,853 | A | 2/1980 | White | |
| 4,381,065 | A | 4/1983 | Hayes | |
| 4,428,509 | A | 1/1984 | Emerson et al. | |
| 4,941,600 | A | 7/1990 | Berriochoa et al. | |
| 5,503,303 | A | 4/1996 | LaWare et al. | |
| 5,702,036 | A | 12/1997 | Ferrara, Jr. | |
| 5,791,524 | A | 8/1998 | Demarest | |
| 6,062,432 | A | 5/2000 | Estrada | |
| 6,241,131 | B1 | 6/2001 | Katsuda et al. | |
| 6,926,172 | B2 | 8/2005 | Jaworski et al. | |
| 6,971,560 | B1 | 12/2005 | Healy et al. | |
| 6,978,947 | B2 | 12/2005 | Jin | |
| 7,195,139 | B2 | 3/2007 | Jaworski | |
| 7,213,728 | B2 | 5/2007 | Kutsch et al. | |
| 2007/0181609 | A1* | 8/2007 | Rymer | B65D 83/205 222/402.1 |
| 2008/0277411 | A1* | 11/2008 | Beland | B65D 83/205 222/52 |
| 2014/0191001 | A1* | 7/2014 | Shemesh | B65D 83/262 222/649 |

* cited by examiner

*Primary Examiner* — Donnell Long

(57) ABSTRACT

A time-delay actuator assembly is disclosed that can dispense chemicals from an aerosol container. The time-delay actuator assembly is mountable to the aerosol container and includes an inner cap, an outer cap adjacent the inner cap, a retainer coupled to the outer cap, a biasing member, and a time-delay member between the inner cap and the outer cap that resists essentially axial movement between the inner cap and the outer cap when the outer cap has been rotated to align a guide member with an essentially axial section of a guide track, thereby causing a time-delay between when the guide member is aligned with the essentially axial section and when chemicals are dispensed from the aerosol container.

20 Claims, 7 Drawing Sheets

TIME-DELAY ACTUATOR ASSEMBLY FOR AN AEROSOL CONTAINER

CROSS-REFERENCE TO RELATED APPLICATIONS

This application claims priority based on U.S. provisional application 62/013,012 filed Jun. 17, 2014.

STATEMENT REGARDING FEDERALLY SPONSORED RESEARCH/DEVELOPMENT

Not applicable

BACKGROUND OF THE INVENTION

The present invention relates to aerosol dispensing devices, and in particular to actuator assemblies that provide a regulated time-delay between the initial activation of the devices and the actual release of the aerosol contents to the ambient environment.

Aerosol containers dispense a variety of ingredients. One or more chemicals to be dispensed are usually mixed in a solvent and, in any event, typically are mixed with a propellant. Typical propellants are compressed air or other compressed gases, carbon dioxide, a selected hydrocarbon gas, or mixtures of hydrocarbon gases, such as a propane/butane mix. For convenience, materials being dispensed will be referred to herein merely as "chemical(s)," regardless of their chemical nature or intended function. Without limitation, chemicals can include actives such as insect control agents (e.g., a repellent, insecticide, or growth regulator), fragrances, sanitizers, cleaners, waxes or other surface treatments, and/or deodorizers.

The active/propellant mixture is stored under pressure in the aerosol container. The mixture is then sprayed out of the container most often by pushing down or sideways on an activator button at the top of the container that controls a release valve mounted at the top end of the container. The sprayed active may exit in an emulsion state, single phase, multiple phase, and/or be partially gaseous. The aerosol container contents can thus be released via manual pressure (for as long as such manual pressure is provided).

Alternatively, the control valve can be switched to an on position such that essentially the entire contents of the can are automatically dispersed in a single continuous, albeit elongated, burst (e.g., total release foggers), or by intermediate spaced bursts (e.g., automatic dosing systems).

U.S. Pat. No. 6,971,560 discloses a system for providing a time-delay between the initial activation and the actual release of the contents to the ambient. This time-delay provides the operator time to leave the dispense area to avoid being exposed to the chemicals. This is especially desirable when the active being dispensed is an insecticidal fumigant. However, the system relies on an interaction between a cap and an associated stem, where the structure is an external structure that might be disturbed during shipping or otherwise prior to use.

U.S. Pat. No. 6,926,172 discloses a total release type automated dispensing system for an aerosol container that activates upon rotation of an exterior cap. However, the structure does not have a desirable time-delay feature and, in any event, has a somewhat complex construction that may be difficult for the operator to use.

Hence, a need remains to provide improved, inexpensive, and reliable time-delay systems for dispensing chemicals from an aerosol container.

SUMMARY OF THE INVENTION

In one aspect, the invention provides a time-delay actuator assembly suitable for dispensing a chemical to ambient environment from an aerosol container having a release valve. The time-delay actuator assembly comprises an inner cap that defines an opening and that is adapted to mount on the aerosol container. An outer cap is adjacent the inner cap. A retainer is coupled to the outer cap and extends through the opening in the inner cap. An actuator extends from at least one of the outer cap and the retainer, and is adapted to selectively engage the release valve. A biasing member urges the actuator toward the release valve.

A time-delay member separately formed from the retainer and the inner cap and positioned inward of the outer cap and fixed relative to one of the inner cap and the outer cap, the time-delay member being adapted to resist essentially axial movement between the inner cap and the outer cap. A guide track is formed on one of the inner cap and the outer cap, and has a circumferential section and an essentially axial section. A guide member is formed on the other cap than the cap on which the guide track is formed on, and is adapted to engage the guide track.

Rotating the outer cap relative to the inner cap moves the guide member along the circumferential section of the guide track. When the guide member is aligned with the essentially axial section of the guide track the biasing member urges the actuator toward the release valve in a manner such that the resistance of the time-delay member to essentially axial movement between the inner cap and the outer cap causes a time-delay between when the guide member is first aligned with the axial section and when the actuator engages the release valve.

In another aspect the invention provides a method for dispensing a chemical from an aerosol container. The method comprising the steps of obtaining an aerosol container containing a chemical and having a release valve and a time-delay actuator assembly mounted thereon. The time-delay actuator assembly comprises an inner cap that defines an opening and that is adapted to mount on the aerosol container, an outer cap that is adjacent the inner cap, a retainer that is coupled to the outer cap and extends through the opening in the inner cap, an actuator that extends from at least one of the outer cap and the retainer, a biasing member that urges the actuator toward the release valve, and a time-delay member that is separately formed from the retainer and inner cap and positioned inward of the outer cap. The time-delay member is fixed relative to one of the inner cap and the outer cap. The time-delay member is adapted to resist essentially axial movement between the inner cap and the outer cap. A guide track is formed in one of the inner cap and the outer cap, and has a circumferential section and an essentially axial section, and a guide member that is formed on the other cap than the cap on which the guide track is formed on, and is adapted to engage the guide track.

The method further comprises rotating the outer cap relative to the inner cap from a storage position, at which the actuator is spaced apart from the release valve, toward a time-delay position by moving the guide member along the circumferential section of the guide track. The guide member is aligned with the essentially axial section of the guide track such that the biasing member urges the actuator toward the release valve against resistance of the time-delay member during a time-delay, and such that the actuator engages the release valve after the time-delay causing the chemical to be dispensed from the aerosol container.

In use a consumer will rotate the outer cap and then will have a specified period, such as about thirty seconds, to leave the area before spraying starts. The structure is relatively inexpensive to produce and reliable. Further, because the time-delay feature is internal, the time-delay feature is resistant to being disturbed during shipping or the like.

The foregoing and other aspects of the invention will become apparent from the following description. In the following description reference is made to the accompanying drawings that form a part thereof, and in which there is shown by way of illustration preferred embodiments of the invention. Such embodiments do not represent the full scope of the invention. Reference should therefore be made to the claims herein for interpreting the scope of the invention. The use of relative/directional terms (e.g., upper, lower, top, bottom, etc.) are used for convenience in describing the example embodiments, and in no way limit the scope of the invention.

DETAILED DESCRIPTION

Figure 1:
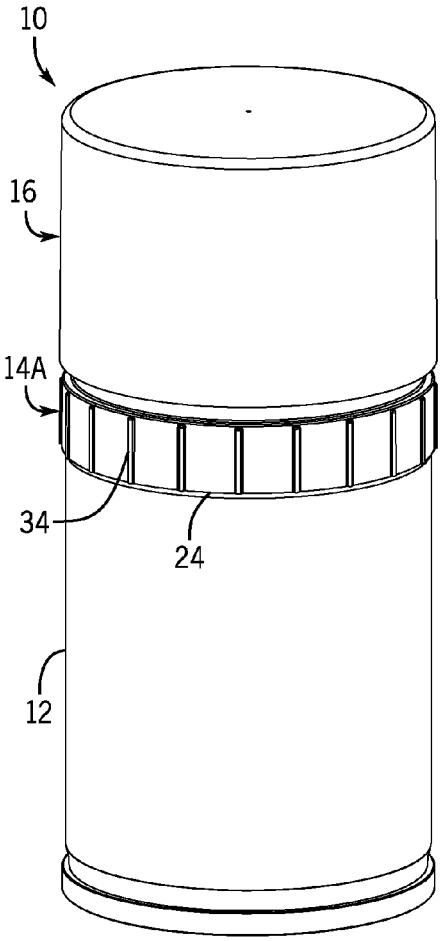
FIG. 1 is a top, frontal perspective view of an example time-delay actuator assembly of the present invention.
Figure 2:
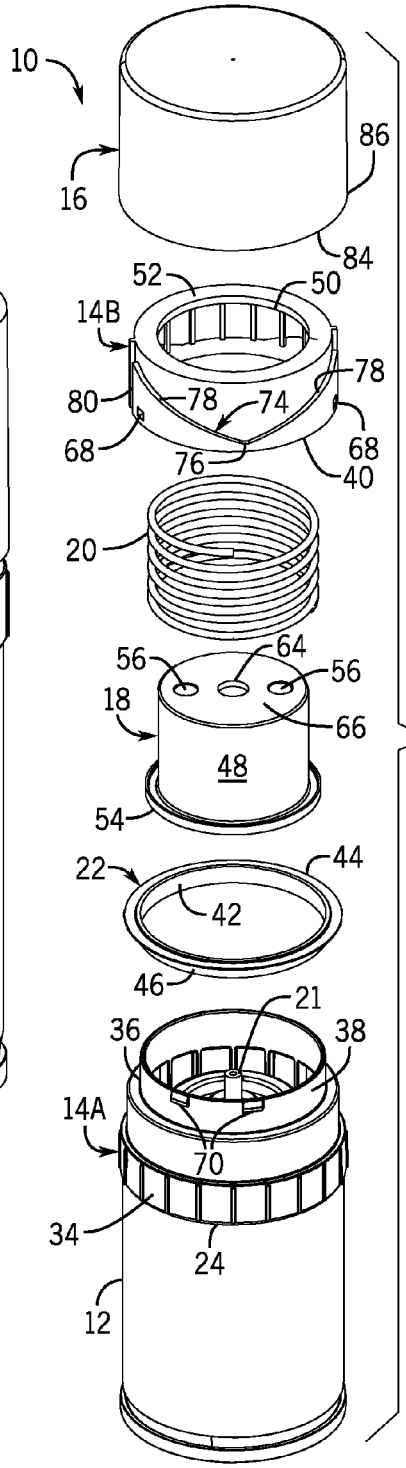
FIG. 2 is an exploded view thereof.

A first example time-delay actuator assembly (10), which is shown configured to dispense a chemical (e.g., insecticide) to ambient environment from an aerosol container (12), is illustrated in FIGS. 1-11. The example time-delay actuator assembly (10) includes a lower inner cap (14A), an upper inner cap (14B), an outer cap (16), a retainer (18), a biasing member (20), and a time-delay member (22). Rotation of the outer cap (16) relative to the assembled lower inner cap (14A) and upper inner cap (14B) increases the potential energy of the biasing member (20) that is ultimately used to urge the retainer (18) toward a release valve (21) of the aerosol container (12), thereby dispensing the chemical. However, the example time-delay actuator assembly (10) includes the time-delay member (22) that resist axial movement of the outer cap (16) relative to the time-delay member (22), thereby establishing a time-delay before the chemical is dispensed from the aerosol container (12), even when one tries to start the dispensing.

Figure 8:
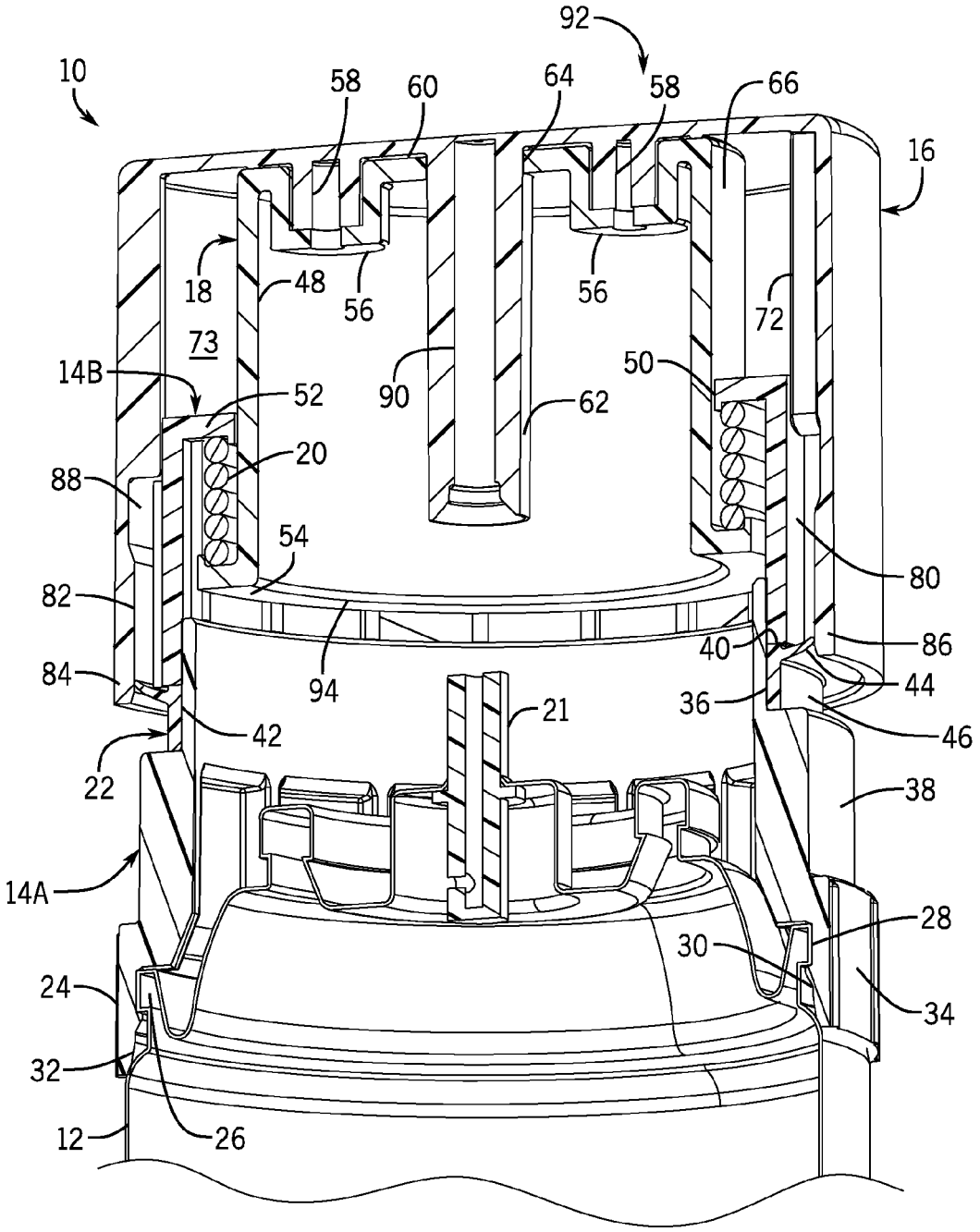
FIG. 8 is a partial axial section view taken along line 8-8 of FIG. 7 showing the example time-delay actuator assembly in the FIG. 7 position.

The example lower inner cap (14A) includes a collar (24) that is adapted to mount on a rim (26) of the aerosol container (12). For instance, and as illustrated in FIG. 8, the collar (24) may define an annular channel (28) having a lip (30) on an inside surface (32) of the collar (24) that captures the rim (26) in the annular channel (28) when the lower inner cap (14A) is secured to the aerosol container (12). The collar (24) also defines a contoured grip (34) to aid relative rotation of the outer cap (16).

The time-delay member (22) is seated in a recess (36) generally formed on an exterior surface (38) of the lower inner cap (14A) and an end face (40) of the upper inner cap (14B) when the upper inner cap (14B) is assembled to the lower inner cap (14A). With specific reference to FIGS. 2, 8, and 11, the time-delay member (22) is illustrated in the form of an annular ring having an interior surface (42) adjacent the exterior surface (38) of the lower inner cap (14A). The time-delay member (22) further includes a flexible annular flange (44) extending radially outward from an exterior surface (46) of the annular ring. When the balance of the time-delay actuator assembly (10) is installed, the flexible annular flange (44) resists axial movement of the outer cap (16), thereby establishing a time-delay, as will be described. The example time-delay member (22) may be made of a resilient material (e.g., rubber, plastic, and the like) that allows the flexible annular flange (44) to deform during operation of the time-delay actuator assembly (10).

In the example time-delay actuator assembly (10) the biasing member (20) and the upper inner cap (14B) are captured between the retainer (18) and the outer cap (16). The retainer (18) includes a cylindrical portion (48) over which the biasing member (20) (e.g., a compression spring) is seated. The upper inner cap (14B) defines an opening (50) through which the cylindrical portion (48) of the retainer (18) extends, capturing the biasing member (20) between the retainer (18) and the upper inner cap (14B).

Figure 9:
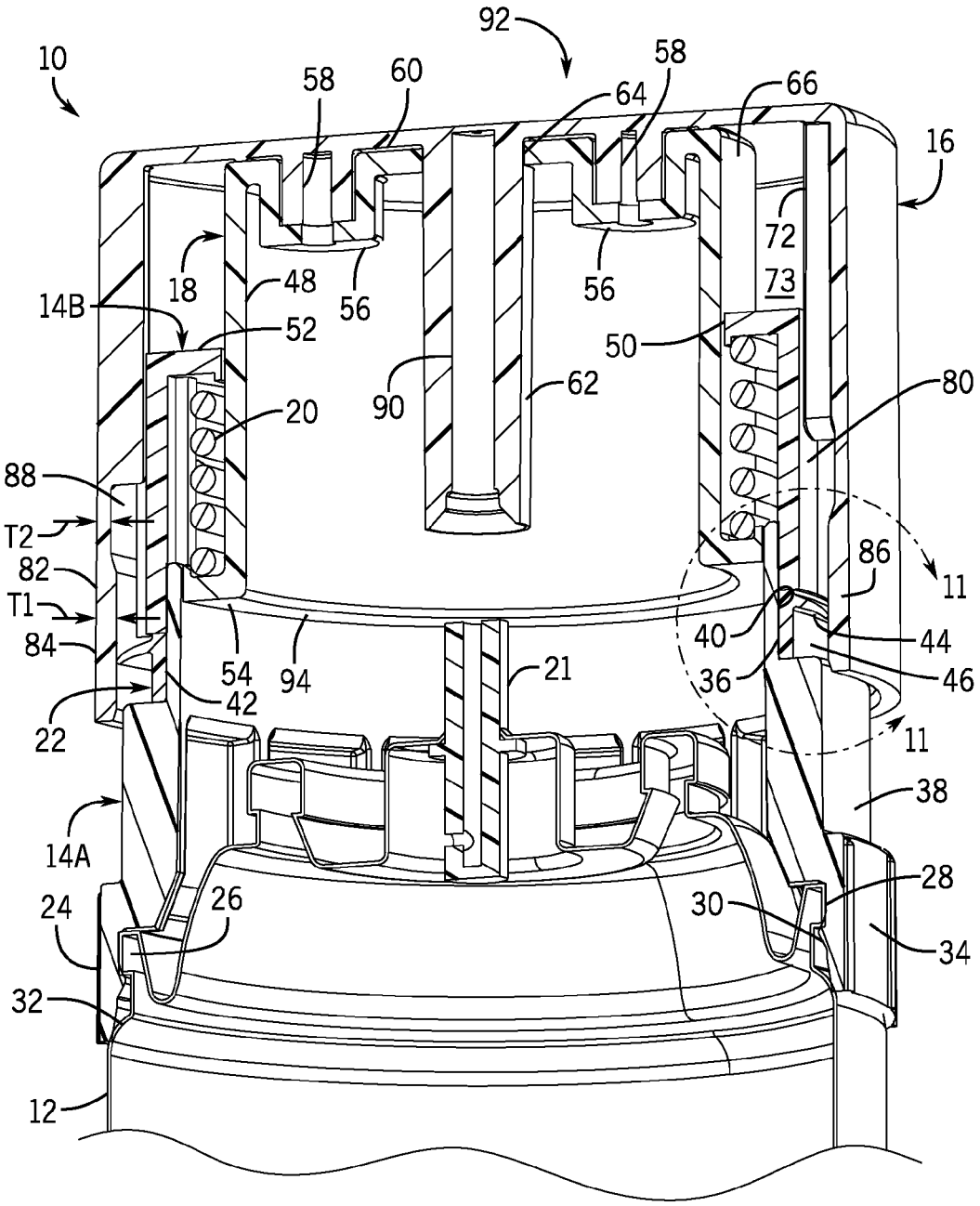
FIG. 9 is a partial axial section view showing an example time-delay member resisting axial movement between the example inner cap and the example outer cap.
Figure 10:
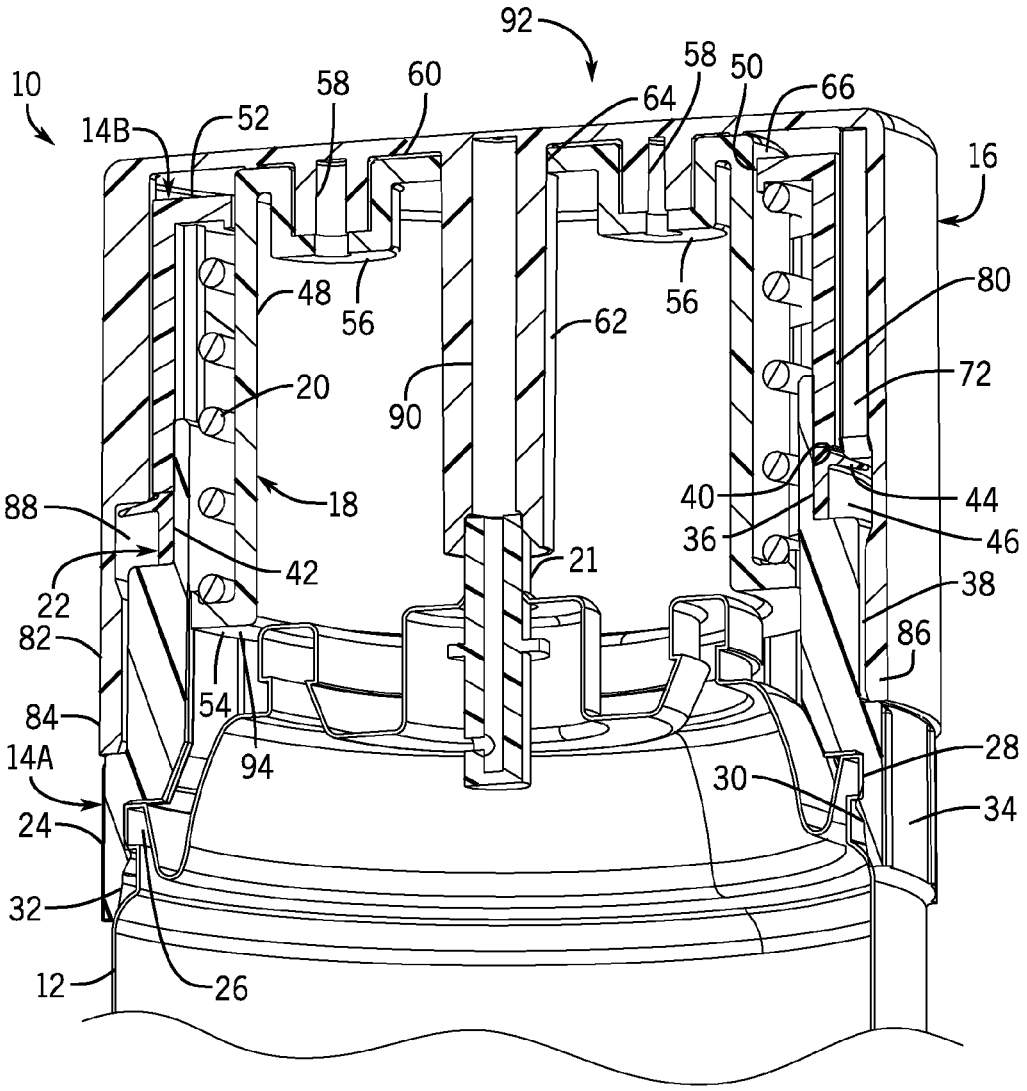
FIG. 10 is a partial axial section view showing the example actuator engaging the release valve of the aerosol container.

Specifically, as shown in FIGS. 8-10, the biasing member (20) is seated between an upper flange (52) defined by the upper inner cap (14B) and a lower flange (54) defined by the retainer (18). An actuator (62) integrally formed in the outer cap (16) then extends into the cylindrical portion (48) of the retainer (18).

Figure 3:
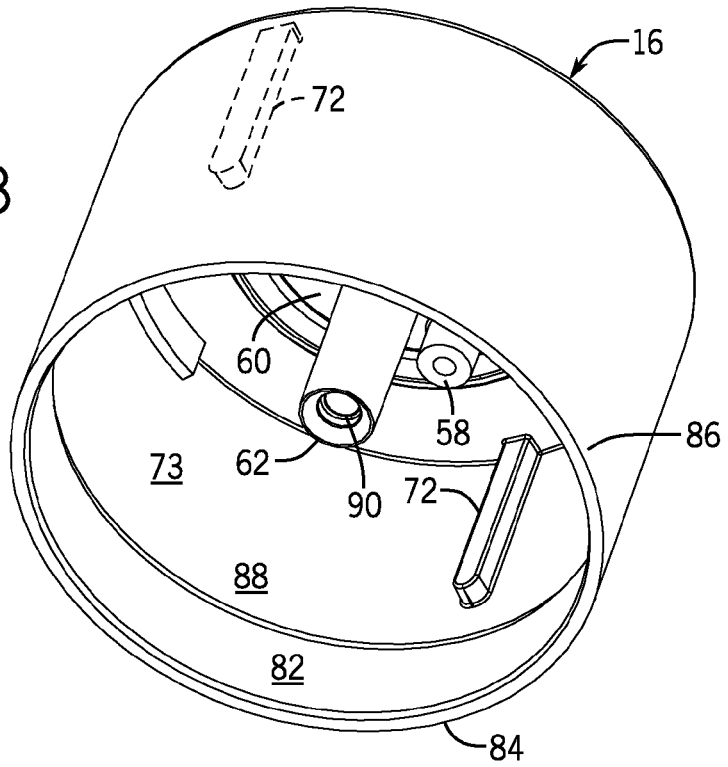
FIG. 3 is a bottom perspective view of an example outer cap.
Figure 4:
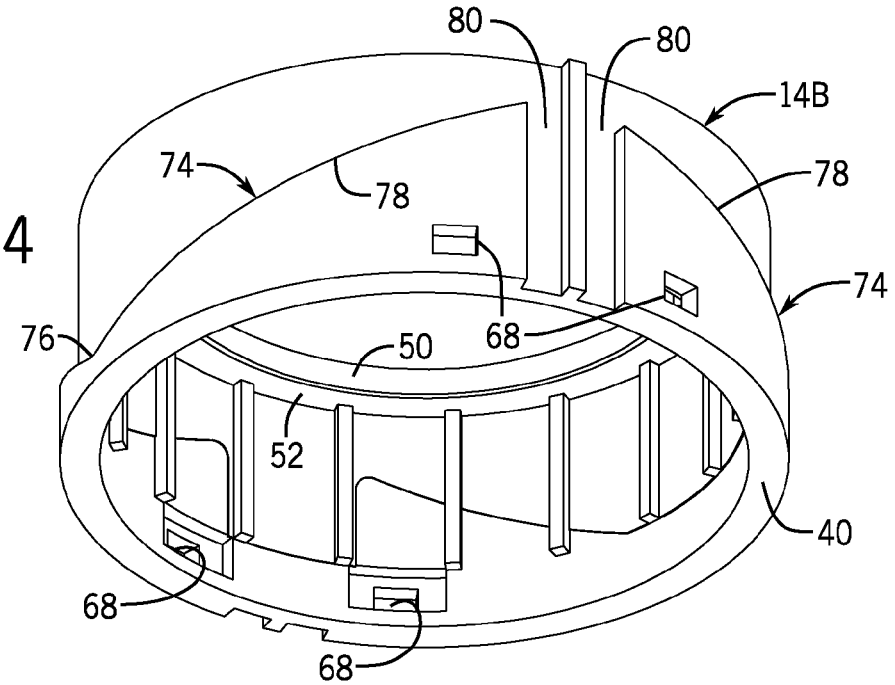
FIG. 4 is a bottom perspective view of an example upper inner cap.

Turning to FIGS. 3 and 8, the retainer (18) and outer cap (16) are rotatably interlocked. The retainer (18) includes a pair of cylindrical depressions (56) into which a mating pair of cylindrical protrusions (58) seat within. The cylindrical protrusions (58) extend from an interior axial surface (60) of the outer cap (16) and are spaced to align with the cylindrical depressions (56) formed on a top end (66) of the retainer (18). The retainer (18) and outer cap (16) may be fixed to each other via fasteners (e.g., screws) axially engaged with the cylindrical depressions (56) and cylindrical protrusions (58) or such as by ultrasonic welding, provided the retainer (18) and outer cap (16) are made of a suitable material (e.g., plastic). Although a pair of cylindrical depressions (56) are shown to mate with a pair of cylindrical protrusions (58), other embodiments may include two or more cylindrical depressions dimensioned to receive corresponding cylindrical protrusions in order to rotatably interlock the retainer (18) and the outer cap (16).

The actuator (62) extends from the interior axial surface (60) and is configured to selectively engage the release valve (21), as will be described below. The actuator (62) extends through an opening (64) formed in the top end (66) of the retainer (18) to extend toward the release valve (21) when the outer cap (16) is assembled to the balance of the time-delay actuator assembly (10).

With the outer cap (16) adjacent to and co-axial with the upper inner cap (14B), the upper inner cap (14B) is partially nested within the outer cap (16) and then assembled to the lower inner cap (14A). Specifically, and with additional reference to FIGS. 2 and 4, the upper inner cap (14B) includes two pair of notch openings (68) into which mating resilient latch fingers (70) formed on the exterior surface 38 of the lower inner cap (14A) are snapped into, thereby coupling the lower inner cap (14A) and the upper inner cap (14B). While the two pair of notch openings (68) and corresponding resilient latch fingers (70) are illustrated as being positioned on opposing circumferential sides of the upper inner cap (14B) and the lower inner cap (14A), respectively, the upper inner cap (14B) may include individual notch openings, for example, circumferentially spaced from one another and configured to mate with corresponding resilient latch fingers circumferentially spaced along the exterior surface (38) of the lower inner cap (14A). The time-delay actuator assembly (10) is then mounted to the aerosol container (12).

One skilled in the art will appreciate that the lower inner cap (14A) and the upper inner cap (14B) may be formed as a single component (e.g., a single molded component). Where the inner cap is a unitary component, the time-delay member (22) may be seated in a recess formed in the inner cap by, for instance, heating the time-delay member (22) and/or stretching it over the inner cap to seat the time-delay member (22) into the recess.

With specific reference to FIGS. 3-7 of the example embodiment, the outer cap (16) is rotatable relative to the upper inner cap (14B) in either a clockwise direction (e.g., arrow (A)) or a counterclockwise direction, both of which may trigger the time-delay feature of the time-delay actuator assembly (10). The outer cap (16) includes a pair of guide members in the form of guide projections (72) that are integrally formed with the outer cap (16) and extend generally longitudinally along an interior surface (73) of the outer cap (16) (best shown in FIG. 3). In the embodiment shown, the guide projections (72) are disposed on opposing circumferential sides of the outer cap (16). Each guide projection (72) is adapted to engage a guide track (74) integrally formed in the upper inner cap (14B). The time-delay actuator assembly (10) is illustrated in the storage position in FIG. 5. When in the storage position, the actuator (62) is axially spaced apart from the release valve (21) of the aerosol container (12) to inhibit the contents of the aerosol container (12) from being inadvertently dispensed during shipping and handling, for example.

In the storage position, the guide projection (72) of the outer cap (16) is positioned at a valley (76) of a circumferential section (78) of the guide track (74). As noted above, the engagement between the guide projection (72) and the valley (76) inhibits the outer cap (16) from moving axially downward toward the release valve (21) and thus dispensing the chemical from the aerosol container (12).

Figure 6:
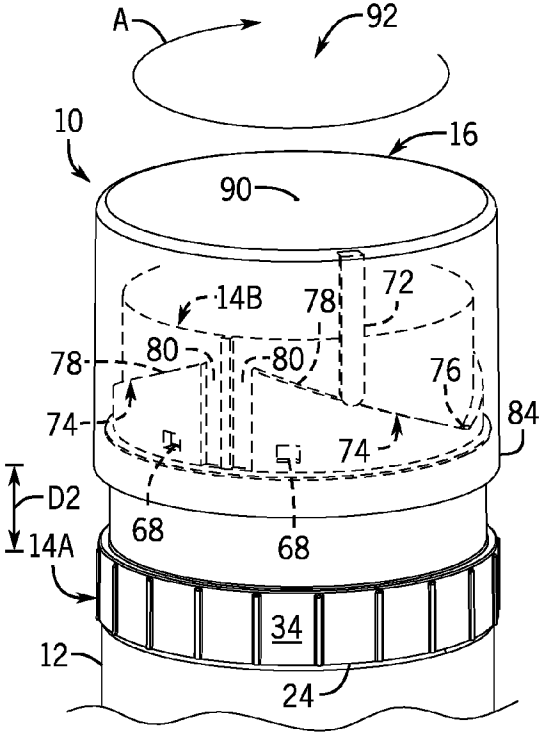
FIG. 6 is a partial perspective view showing the example outer cap partially rotated relative to the example upper inner cap.
Figure 5:
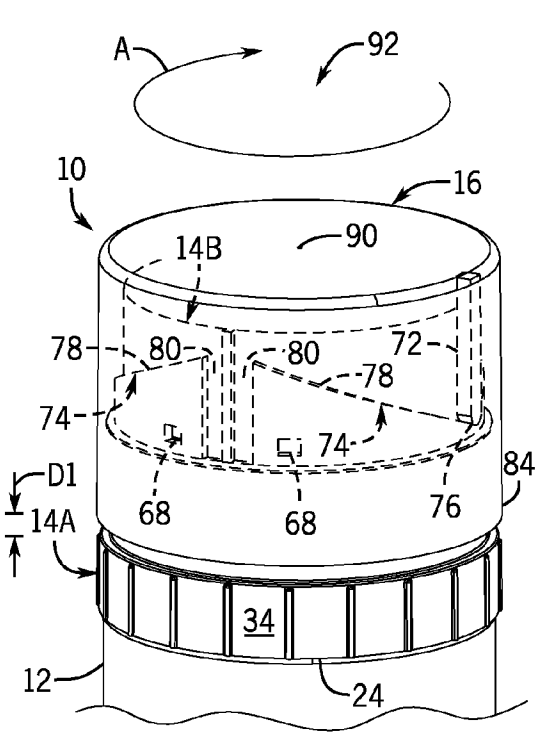
FIG. 5 is a partial perspective view showing the example time-delay actuator assembly in the storage position.

With specific reference to FIG. 6, rotating the outer cap (16) relative to the upper inner cap (14B) in the direction indicated by arrow (A), for example, results in the guide projection (72) riding upward along the circumferential section (78) of the guide track (74). Thus, upon rotation, the outer cap (16) moves upward and away from the upper inner cap (14B), as shown by an increase in distance between D1 and D2 illustrated in FIGS. 5 and 6, respectively. Essentially simultaneously, the retainer (18) secured to the outer cap (16) further compresses the biasing member (20) (increasing the potential energy (i.e., urging) of the biasing member (20)) as the guide projection (72) slides upward along the guide track (74). While the circumferential section (78) of the guide track (74) is illustrated as a general smooth/continuous ramp, one skilled in the art will appreciate that the circumferential section (78) may be of various configurations, such as stepped, saw toothed, curved and the like.

Figure 7:
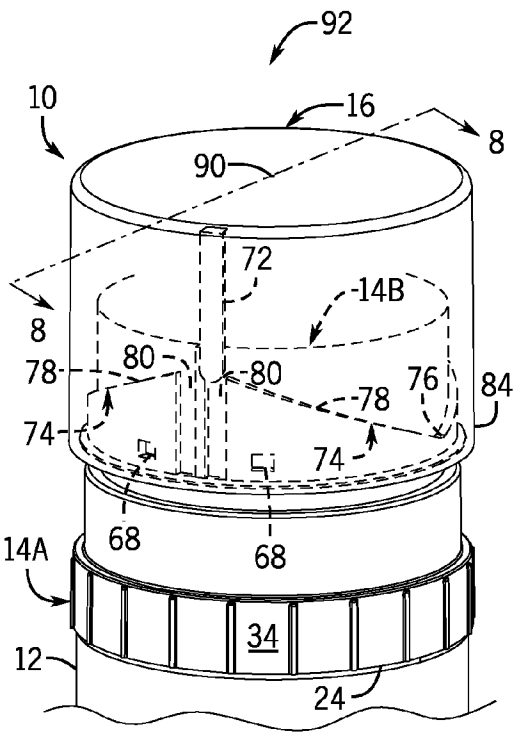
FIG. 7 is a partial perspective view showing the example time-delay actuator assembly in the about to be activated position.

When the outer cap (16) is fully rotated, as illustrated in FIG. 7, the time-delay actuator assembly (10) is in the about to be actuated position, and the guide projection (72) is aligned with an axial section (80) of the guide track (74), allowing the biasing member (20) to urge the outer cap (16) axially downward.

The guide projections (72) are shown aligned with the mating axial sections (80) in FIG. 8 placing the time-delay actuator assembly (10) in the activated position. When the outer cap (16) and upper inner cap (14B) are so aligned, the biasing member (20) urges the outer cap (16) and coupled retainer (18) downward (as viewed in FIGS. 8-10), such that the actuator (62) axially moves toward the release valve (21) of the aerosol container (12).

A time-delay occurs because, as best shown in FIG. 9, as the biasing member (20) drives the outer cap (16) and retainer (18) downward, the flexible annular flange (44) of the time-delay member (22) engages, deforms, rubs, and wipes against the outer cap (16). Specifically, the outer cap (16) defines a time-delay portion (82) near an end (84) of the outer cap (16).

As viewed in cross section, the time-delay portion (82) of the example embodiment is defined by an annular rim (86) having a wall thickness T1 that is greater than a wall thickness T2 of an adjacent annular recess (88) formed on an interior surface (73) of the outer cap (16), as shown in FIG. 9. Thus, in the example time-delay actuator assembly (10), the time-delay member (22) positioned between the outer cap (16) and the upper inner cap (14B), and fixed relative to the upper inner cap (14B), resists essentially axial movement between the outer cap (16) and the upper inner cap (14B) by engaging the time-delay portion (82) of the outer cap (16).

Turning to FIG. 10, when the annular recess (88) of the outer cap (16) is moved adjacent to the flexible annular flange (44) of the time-delay member (22), the flexible annular flange (44) is received in the annular recess (88) such that the time-delay member (22) no longer engages the outer cap (16), allowing the biasing member (20) to drive the actuator (62) into engagement with the release valve (21). Without the engagement between the time-delay member (22) and the outer cap (16) providing axial resistance against the biasing member (20), the urging of the biasing member (20) drives the actuator (62) into operative engagement with the release valve (21) of the aerosol container (12) such that chemical is dispensed from the aerosol container (12) through a passage (90) in the actuator (62) to ambient (92).

The time-delay establishes a delay between when the guide projection (72) is aligned with the axial section (80) and when the actuator (62) engages the release valve (21), thus dispensing the chemical, and that is greater than a time-delay that would exist without the influence of the time-delay members (22), (82). The time-delay may be adjusted to any application specific period, and in some forms is between about five seconds and about one minute.

The lower inner cap (14A), the upper inner cap (14B), the outer cap (16), and the retainer (18) may be molded from plastic or made from any other suitable material given the specific application requirements. For example, where extreme conditions exist and/or reusability is desired, various components may be made of metals and/or composites. In one form, the biasing member (20) is made of metal (e.g., a metallic compression spring), however, the biasing member (20) may have various other form factors incorporating a variety of materials (e.g., a resilient rubber cylindrical sleeve, one or more Belleville washers, and the like).

As one skilled in the art will appreciate, given the benefit of this disclosure, various modifications may be made to the example time-delay actuator assembly (10) described. For example, the guide member (72) may be formed in the outer cap (16) and the guide track (74) may be formed in the lower inner cap (14A) or the upper inner cap (14B). Moreover, the actuator (62) may be integral with the retainer (18) such that the actuator (62) moves essentially axially in connection with the retainer (18) to selectively engage the release valve (21) of the aerosol container (12). The retainer (18) may also be integral with the outer cap (16). And, the biasing member (20) (e.g., an extension spring) may be coupled to a bottom face (94) of the retainer (18) and to one of the aerosol container (12), the lower inner cap (14A), or the upper inner cap (14B) such that the biasing member (20) is extended as the outer cap (16) is rotated.

Figure 11:
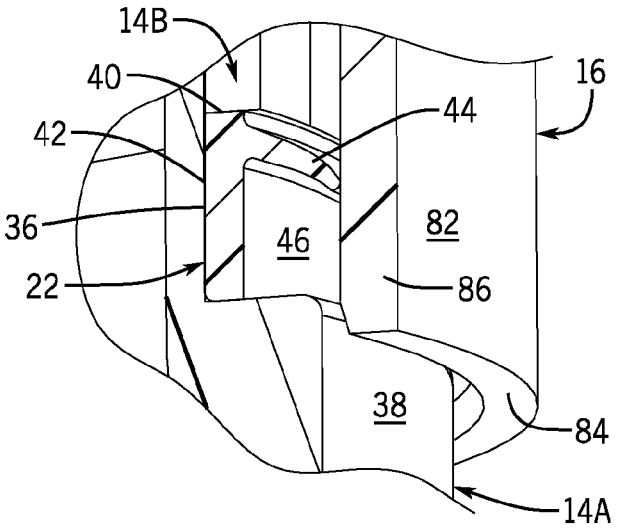
FIG. 11 is a detail view of the area circumscribed by arc 11-11 in FIG. 9 for a first preferred embodiment.
Figure 11A:
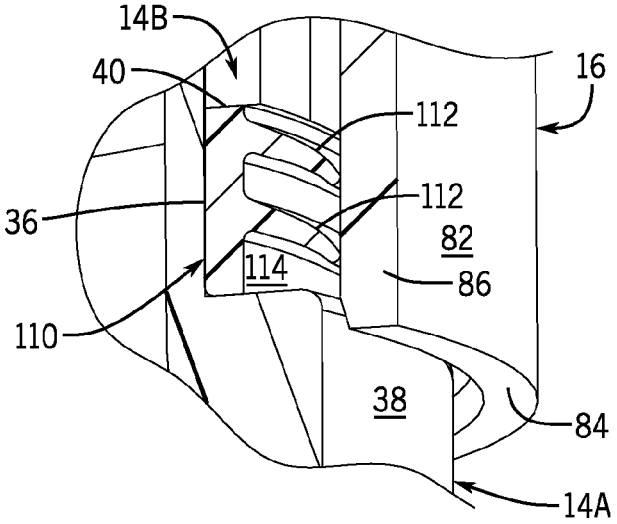
FIG. 11A is a detail view showing an alternative example time-delay member in the form of an annular ring including two parallel annular flanges.
Figure 11B:
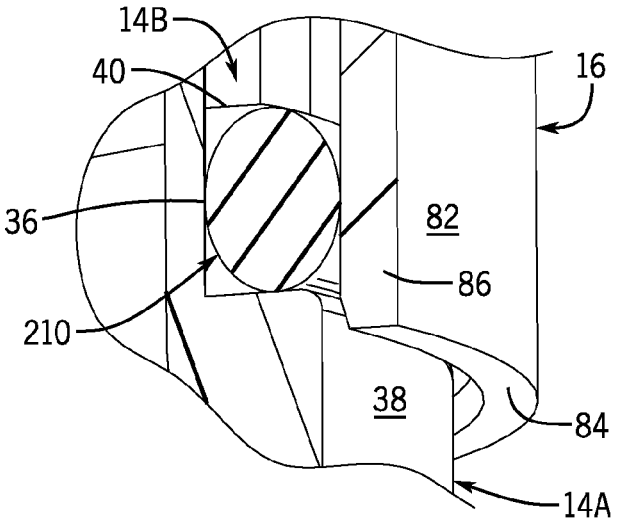
FIG. 11B is a detail view showing another alternative example time-delay member in the form of an o-ring.

Two alternative example time-delay members are illustrated in FIGS. 11A and 11B. In FIG. 11A, an alternative example time-delay member (110) is in the form of an annular ring seated in the recess (36) of the lower inner cap (14A) having two parallel annular flanges (112) that extend circumferentially from an exterior surface (114). As one skilled in the art will appreciate, the construction, rigidity, and number of flanges (or other similar structures) influences the interference between the time-delay member (e.g., 110) and the time-delay portion (82) of the outer cap (16).

In FIG. 11B, an alternative example time-delay member (210) is in the form of an o-ring seated in the recess (36) of the lower inner cap (14A) and having an essentially circular cross section. Thus, the time-delay portion (82) of the outer cap (16) rubs against the time-delay member (210) deforming the o-ring, thereby inhibiting the movement of the outer cap (16) and causing a time-delay.

The above description has been that of preferred embodiments of the present invention. It will occur to those that practice the art, however, that still other modifications may be made without departing from the spirit and scope of the invention. In order to advise the public of the various embodiments that may fall within the scope of the invention, the following claims are made.

INDUSTRIAL APPLICABILITY

The present invention provides actuator assemblies useful for dispensing chemicals from an aerosol container in a time-delayed fashion.

What is claimed is:

1. A time-delay actuator assembly suitable for dispensing a chemical to ambient environment from an aerosol container having a release valve, comprising:

an inner cap defining an opening and adapted to mount on the aerosol container;

an outer cap adjacent the inner cap;

a retainer coupled to the outer cap and extending through the opening in the inner cap;

an actuator extending from at least one of the outer cap and the retainer, and adapted to selectively engage the release valve;

a biasing member urging the actuator toward the release valve;

a time-delay member separately formed from the retainer and the inner cap and positioned inward of the outer cap and fixed relative to one of the inner cap and the outer cap, the time-delay member being adapted to resist essentially axial movement between the inner cap and the outer cap;

a guide track formed on one of the inner cap and the outer cap, and having a circumferential section and an essentially axial section; and a guide member formed on the other one of the inner cap and the outer cap on which the guide track is formed on, and adapted to engage the guide track;

wherein rotating the outer cap relative to the inner cap moves the guide member along the circumferential section of the guide track; and wherein when the guide member is aligned with the essentially axial section of the guide track the biasing member urges the actuator toward the release valve in a manner such that resistance of the time-delay member to essentially axial movement between the inner cap and the outer cap causes a time-delay between when the guide member is first aligned with the axial section and when the actuator engages the release valve.

2. The time-delay actuator assembly of claim 1, wherein the time-delay member comprises an annular ring.

3. The time-delay actuator assembly of claim 2, wherein the annular ring includes at least one annular flange extending radially outward.

4. The time-delay actuator assembly of claim 2, wherein the annular ring has an essentially circular cross section.

5. The time-delay actuator assembly of claim 1, wherein the time-delay member is seated in a recess formed on an exterior surface of the inner cap.

6. The time-delay actuator assembly of claim 1, wherein the inner cap comprises an upper inner cap and a lower inner cap secured together.

7. The time-delay actuator assembly of claim 6, wherein the time-delay member is seated in a recess defined by the upper inner cap and the lower inner cap.

8. The time-delay actuator assembly of claim 1, wherein:

the inner cap further comprises an upper flange;

the retainer further comprises a lower flange; and the biasing member comprises a compression spring seated between the upper flange and the lower flange.

9. The time-delay actuator assembly of claim 1, wherein:

the guide track is integrally formed on the inner cap; and the guide member is integrally formed on the outer cap.

10. The time-delay actuator assembly of claim 1, wherein the actuator is integrally formed with the outer cap.

11. The time-delay actuator assembly of claim 1, wherein the inner cap is partially nested within the outer cap.

12. The time-delay actuator assembly of claim 1, wherein the inner cap and the outer cap are co-axial.

13. The time-delay actuator assembly of claim 1, wherein the outer cap defines an annular recess formed on an interior surface of the outer cap adjacent the time-delay portion and adapted to receive the time-delay member when the actuator is engaged with the release valve.

14. The time-delay actuator assembly of claim 13, wherein the time-delay portion defines an annular rim having a wall thickness that is thicker relative to a wall thickness of the annular recess.

15. A method for dispensing a chemical from an aerosol container, the method comprising the steps of:

obtaining an aerosol container containing a chemical and having a release valve and a time-delay actuator assembly mounted thereon, the time-delay actuator assembly comprising:

an inner cap defining an opening and adapted to mount on the aerosol container;

an outer cap adjacent the inner cap;

a retainer coupled to the outer cap and extending through the opening in the inner cap;

an actuator extending from at least one of the outer cap and the retainer;

a biasing member urging the actuator toward the release valve;

a time-delay member separately formed from the retainer and the inner cap and positioned inward of the outer cap and fixed relative to one of the inner cap and the outer cap, the time-delay member being adapted to resist essentially axial movement between the inner cap and the outer cap;

a guide track formed in one of the inner cap and the outer cap, and having a circumferential section and an essentially axial section; and a guide member formed on the other one of the inner cap and the outer cap on which the guide track is formed on, and adapted to engage the guide track;

rotating the outer cap relative to the inner cap from a storage position at which the actuator is spaced apart from the release valve toward a time-delay position by moving the guide member along the circumferential section of the guide track; and aligning the guide member with the essentially axial section of the guide track such that the biasing member urges the actuator toward the release valve against resistance of the time-delay member during a time-delay, and such that the actuator engages the release valve after the time-delay causing the chemical to be dispensed from the aerosol container.

16. The method of claim 15, wherein the time-delay member comprises an annular ring.

17. The method of claim 15, wherein the time-delay is between about ten seconds and about thirty seconds.

18. The method of claim 15, wherein the outer cap defines an annular recess formed on an interior surface of the outer cap adjacent the time-delay portion and adapted to receive the time-delay member when the actuator is engaged with the release valve.

19. The method of claim 18, wherein the time-delay portion defines an annular rim having a wall thickness that is thicker relative to a wall thickness of the annular recess.

20. The method of claim 15, wherein:

the inner cap further comprises an upper flange;

the retainer further comprises a lower flange; and the biasing member comprises a compression spring seated between the upper flange and the lower flange.

* * * * *